US006203315B1

(12) United States Patent
Magnusson

(10) Patent No.: US 6,203,315 B1
(45) Date of Patent: Mar. 20, 2001

(54) ROTARY BURNER FOR SOLID FUEL

(75) Inventor: Jan Magnusson, Åmål (SE)

(73) Assignee: Swedish Bioburner System Aktiebolag (SE)

( * ) Notice: Subject to any disclaimer, the term of this patent is extended or adjusted under 35 U.S.C. 154(b) by 0 days.

(21) Appl. No.: 09/380,289

(22) PCT Filed: Mar. 3, 1998

(86) PCT No.: PCT/SE98/00374

§ 371 Date: Aug. 30, 1999

§ 102(e) Date: Aug. 30, 1999

(87) PCT Pub. No.: WO98/39600

PCT Pub. Date: Sep. 11, 1998

(30) Foreign Application Priority Data

Mar. 5, 1997 (SE) ..... 9700793
Jun. 23, 1997 (WO) ..... PCT/SE97/01113

(51) Int. Cl.[7] ..... F27B 7/36
(52) U.S. Cl. ..... 432/105; 432/206; 110/246
(58) Field of Search ..... 432/105, 108, 432/109, 206, 207, 208; 110/226, 246

(56) References Cited

U.S. PATENT DOCUMENTS 2,500,553 * 3/1950 Lykken ..... 432/105
3,436,061 * 4/1969 Zinn ..... 110/246
5,662,052 * 9/1997 McIntosh et al. ..... 432/108

* cited by examiner

*Primary Examiner*—Denise L. Ferensic
*Assistant Examiner*—Gregory A. Wilson
(74) *Attorney, Agent, or Firm*—George T. Marcou; Kilpatrick Stockton LLP

(57) ABSTRACT

A device for the combustion of solid fuel in the form of granules, pellets, chips or other fragmented or finely divided form, comprising a rotary reactor drum (1), which forms the main combustion chamber (13) and has a rear end wall (65) and at the opposite end an outlet (3) for combustion gases to a boiler part for heat transfer to water-cooled surfaces, for example, or other heat-absorbing means, an inlet (55) for combustion air to the main combustion chamber (13), means (40) for feeding fuel through the rear end wall (65) of the reactor drum and means for rotating the reactor drum around its center axis (2). Inside the main combustion chamber (13), in its rear part, is an inner, smaller drum (60), which is coaxial with the reactor drum (1) and has a perforated jacket. At least the bulk of the fuel is disposed to be fed into the inner, smaller drum (60) and from this to the surrounding main combustion chamber (13). The smaller drum (60) is disposed to be rotatable with the larger reactor drum (1) around its center axis (2).

15 Claims, 1 Drawing Sheet

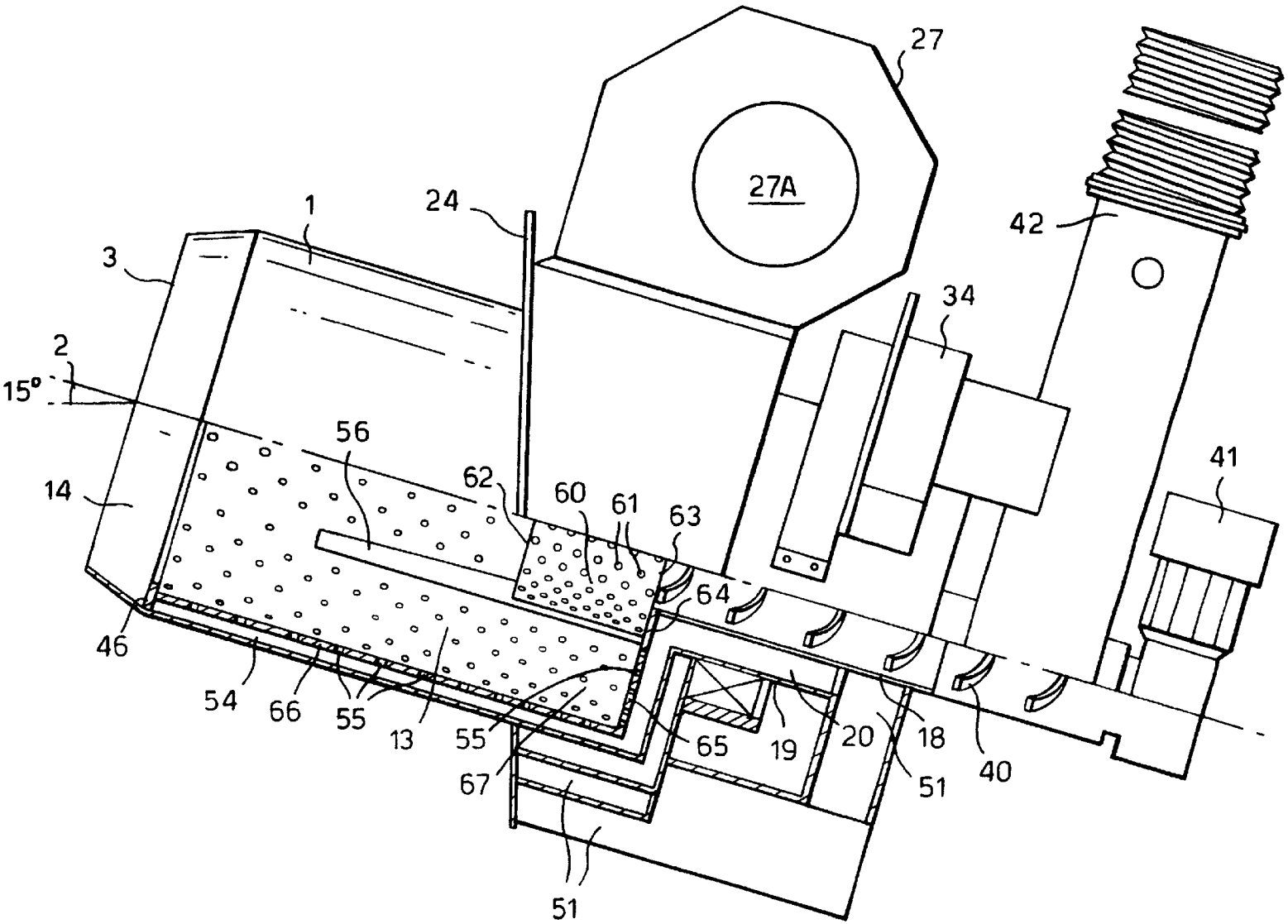
41
42
27
27A
34
40
18
51
20
19
64
65
63
61
60
62
24
1
3
2
15°
14
46
54
66
55
56
13
55
67
51

ROTARY BURNER FOR SOLID FUEL

TECHNICAL FIELD

The invention relates to a device for the combustion of solid fuel in the form of granules, pellets, chips or other fragmented or finely divided form, comprising a rotary reactor drum, which forms the main combustion chamber and has a rear end wall and at the opposite end an outlet for combustion gases to a boiler part for heat transfer to water-cooled surfaces, for example, or other heat-absorbing means, an inlet for combustion air to the main combustion chamber, means for feeding fuel through the rear end wall of the reactor drum and means for rotating the reactor drum around its centre axis.

BACKGROUND TO THE INVENTION

Combustion devices of the type specified above have been known for a long time and a number of different designs have been suggested over the years. The Swedish patent specification 450734 shows a combustion device which is used to a large extent. The Swedish patent application 9602495-5, which has not yet been published, shows another, improved combustion device with a double-walled reactor drum, in which the space between the inner and outer reactor walls is divided into longitudinal channels, means being disposed for leading combustion air into at least some of these channels and the inner reactor drum wall being provided with through holes for the introduction of combustion air from the channels into the combustion chamber in the reactor drum.

BRIEF DESCRIPTION OF THE INVENTION

The object of the invention is to provide a combustion device of the type specified in the preamble, which can generate more power than other combustion devices of the same size and equipped in the same manner. These and other aims can be achieved by what is specified in the characterizing part of the appending claim 1.

Further features and aspects of the invention are apparent from the sub-claims and from the following description of a preferred embodiment.

BRIEF DESCRIPTION OF THE DRAWINGS

The enclosed drawing shows a side view, partly in section, of a preferred embodiment of the device according to the invention.

DESCRIPTION OF A PREFERRED EMBODIMENT

The device shown in the drawing comprises the following main components: a reactor drum 1, the inside of which forms a main or primary combustion chamber 13, an after- or secondary combustion chamber 14, a fan 27 for combustion air, a feed screw 40 in a fuel feed pipe 18 for solid fuel in the form of particles, a motor 41 for rotating the feed screw 40, a driving device 34 for rotating the reactor drum 1 around an inclined axis of rotation 2, a down pipe 42 for the fuel and air conduits, here designated 51, for the combustion air. The angle of inclination of the reactor drum 1 in relation to the horizontal, with the front opening 3 of the reactor drum for combustion gases directed obliquely upwards, amounts to 15°.

The rear end wall 65 of the reactor drum 1, like the main portion of its cylindrical part 66, is double-walled. The space between the inner and outer walls is designated 54. The inner wall is provided with holes 55 both in the cylindrical part and in the rear end part for the introduction of combustion air into the main combustion chamber 13. Furthermore, the intermediate space 54 is divided into channels, such as described in detail in said SE96024955-3, which is hereby incorporated by reference into the present specification. More precisely, the air that flows through these channels can be regulated by valves, so that the combustion air is introduced preferably or mainly into the parts of the main combustion chamber 13 where the fuel accumulates. To stir the fuel, fingers 56 are also located on the inside of the reactor drum 1, which extend from a distance behind the front opening 3 right back to the rear wall 65 and follow the rotation of the reactor drum 1.

A difference in relation to the device according to said SE9602495-5 is that the air is drawn in by the fan 27 through an air intake 27A and pushed via the air conduits 51 and via the slide valve (not shown) into the air injection pipe/axle 19, and from the inside 20 of this on into the channels in the intermediate space 54 and finally through the holes 55 into the combustion chamber 13.

The characteristic feature of the invention, however, is in the first instance an inner, smaller drum 60 in the rear part of the reactor drum 1. The inner, smaller drum 60 is cylindrical and has a perforated jacket. According to the embodiment, the drum consists of a sheet metal drum with holes in the jacket, but a net drum is also conceivable. The holes in the jacket are designated 61. These are so small—the diameter or greatest extension amounts to 10 mm maximum, preferably 8 mm maximum—that the fuel particles cannot pass through them to any considerable degree. In front, the drum 60 is completely open. This opening is designated 62. The drum 60 is coaxial with the reactor drum 1 and surrounds a central feed opening 63 which forms the orifice of the feed tube 18 for the fuel, which is fed in by the feed screw 40. The diameter of the drum 60 is somewhat larger than the opening 63. In the annular space 64 between the feed opening 63 and the drum 60, the rear end wall 65 of the reactor drum 1 has no inlet openings for combustion air. However, an alternative of this kind is conceivable, i.e. air injection openings in the said annular space 64 also. The drum 60 is welded to the rear end wall of the reactor drum 1.

During operation, the reactor drum 1 rotates and with it also the inner drum 60, at the same time as fuel is fed through the central opening 63 by means of the feed screw into the smaller, inner drum 60. The fuel then falls through the front opening 62 and down towards the wall of the reactor drum 1 and further down into the space 67 between the reactor drum 1 and the inner drum 60 in the rear part of the main combustion chamber 13. The fuel in the main combustion chamber 13 is burned by means of the primary air which is blown in through the openings 55 in the jacket and in the rear end wall. The fuel which is gradually fed into the inner drum 60 is dried in this drum before continuing into the main combustion chamber. The inner drum 60 therefore functions as a pre-fire-grate, in which any remaining moisture in the fuel is substantially eliminated. In addition, the smaller drum 60 appears to function in such a way that more fuel can accumulate during combustion in the main combustion chamber, in that the annular space 67 is more or less filled with fuel which, by means of the fingers 56 interacting with the inner drum 60, follows the rotation of the combustion device, which further increases the power generation of the combustion device.

It should also be mentioned in this connection that the drum 1 does not necessarily have to be rotated continuously and at a constant speed. The speed can be varied depending on the power generation required and can also take place intermittently. Changes between continuous and intermittent rotation can also take place. Air also flows out through a number of openings 46 in the bottom part of the annular end wall, which limits the space 54 forwards and thereby the channels in the said space. The secondary air which is thus blown out through the openings 46 maintains the combustion in the after-or secondary combustion chamber 14, in particular the combustion of products which were not completely burnt in the main or primary combustion chamber 13 but passed out into the after-combustion chamber 14. To hinder these products from passing unburnt out through the opening 3, the front part of the after-combustion chamber is designed to be conically tapering.

In the rear part of the drum 1, i.e. in the inner part 67 of the primary or main combustion chamber 13, in the area of the inner drum 60, where the distribution of air injection openings 55 in the jacket is densest, and where the combustion air also is injected through the holes in the rear wall, the temperature is nevertheless comparatively, low, normally approx. 700–800° C., which is favourable from the environmental point of view with regard to the fact that this part of the burner is outside the boiler. In the front part of the drum 1, and in particular in the secondary or after-combustion chamber 14, where "fresh" combustion air is supplied through the holes 46 to whole but unburnt or incompletely burnt combustible products, the temperature may rise to over 1000–1300° C., typically approx. 1250° C., which is favourable, since this gives an efficient heat transfer to the convection part of the boiler, which is not shown.

It is to be understood that the device can be varied within the scope of the invention. For example, the rotating drum 1 can be disposed completely horizontally. In this case, however, the drum should be made tapering, e.g. conically tapering, from the rear wall forwards, so that the bottom of the drum has roughly the same angle of inclination as shown in the embodiment described, i.e. 15°, due to which the fuel in this case will accumulate in the rear part 67 of the drum, where the injection of primary air is concentrated. Furthermore, it is conceivable not to have any sharp corner at the transition between the rear end wall and the side wall corresponding to the drum's jacket, but instead to have a bevelled transition. A design which is most suitable from some points of view, however, has a burner which is completely void of corners, e.g. a burner with the principal shape of an egg or pear cut off at both ends, in which the more pointed part is directed forwards towards the outlet opening. In this case also the burner is double-walled with the intermediate space between the walls divided into channels, or otherwise provided with channels for combustion air from the air inlet pipe, which surrounds the central fuel feed pipe, and further outwards and forwards.

What is claimed is:

1. Device for the combustion of solid fuel in the form of granules, pellets, chips or other fragmented or finely divided form, comprising a rotary reactor drum (1), which forms the main combustion chamber (13) and has a rear end wall (65) and at the opposite end an outlet (3) for combustion gases, an inlet (55) for combustion air to the main combustion chamber (13), means (40) for feeding fuel through the rear end wall (65) of the reactor drum and means for rotating the reactor drum around its centre axis (2), characterized in that located inside the main combustion chamber (13), in its rear part, is an inner, smaller drum (60), which is coaxial with the reactor drum (1) and has a perforated jacket, that at least the bulk of the fuel is disposed to be fed into the inner, smaller drum (60) and from this to the surrounding main combustion chamber (13), and that the smaller drum (60) is disposed to be rotatable with the larger reactor drum (1) around its centre axis (2).

2. Device according to claim 1, characterized in that the outer diameter of the inner drum (60) is at least one-quarter and at most three-quarters of the inner diameter of the reactor drum.

3. Device according to claim 2, characterized in that the inner drum (60) has a length of at least one-fifth and at most three-fifths of length of the reactor drum.

4. Device according to claim 3, characterized in that the inner drum has a length of at least one quarter and at most half of length of the reactor drum.

5. Device according to claim 2, characterized in that the outer diameter of the inner drum is at least one-third and at most two-thirds of the inner diameter of the reactor drum.

6. Device according to claim 1, characterized in that the inner, perforated drum openings (61) in the drum jacket have a diameter or maximum extension of 10 mm max., so that at least the bulk of the solid fuel cannot pass through these openings but only through a front opening (62) of the smaller drum.

7. Device according to claim 6, characterized in that the diameter or maximum extension is 8 mm max.

8. Device according to claim 1, characterized in that the reactor drum (1) slopes, so that the outlet (3) for combustion gases is turned obliquely upwards, whereby the fuel, when it leaves the inner drum (60) through the front opening (62) thereof, basically accumulates in the rear, annular space (67) of the burner between the inner drum and the reactor drum.

9. Device according to claim 8, characterized in that the angle of inclination in relation to the horizontal plane is 5–30°.

10. Device according to claim 9, characterized in that the angle of inclination in relation to the horizontal plane is 10–20°.

11. Device according to claim 9, characterized in that the angle of inclination in relation to the horizontal plane is 15°.

12. Device according to claim 1, characterized in that the inlet openings (55) for combustion air are located both in the area of the rear end wall (65) of the reactor drum, at least outside the inner drum, and in the area between the end wall and the front outlet opening.

13. Device according to claim 12, characterized in that there are no inlet openings for combustion air in the end wall in the annular area (64) behind the inner, smaller drum (60) between a feed opening (63) for fuel and said smaller drum.

14. Device according to claim 1, characterized in that the burner has the shape of a cylindrical or conically tapering drum.

15. Device according to claim 1, characterized in that the burner has the substantial shape of an egg, pear or other double-curved shape cut off at both ends, in which the rear wall gradually passes over into the side wall.

* * * * *

UNITED STATES PATENT AND TRADEMARK OFFICE

CERTIFICATE OF CORRECTION

PATENT NO. : 6,203,315 B1
DATED : March 20, 2001
INVENTOR(S) : Jan Magnusson

It is certified that error appears in the above-identified patent and that said Letters Patent is hereby corrected as shown below:

Title page,
Item [56], add the following references to those already cited:

-- U.S. PATENT DOCUMENTS

| | | | |
|---|---|---|---|
| 3,513,788 | 5/1970 | Ostrin | 110/8 |

FOREIGN PATENT DOCUMENTS

| | | | |
|---|---|---|---|
| 0 346 531 A | 12/1989 | European Pat. Off. | F23B 1/32 |
| 2 079 910 A | 01/1982 | United Kingdom | F23B 1/32 |

OTHER PUBLICATIONS

International Search Report for PCT/SE 98/00374, dated June 25, 1998
Patent Abstracts of Japan, Vol. 13, No. 25, M-787 (abstract of JP 63-238306 A, Onoda Cement Co. Ltd., October 4, 1988)
PCT Application (PCT/FI95/00192), WIPO No. 95/29366, November 2, 1995 --.

Signed and Sealed this

Twentieth Day of November, 2001

*Attest:*

Nicholas P. Godici

*Attesting Officer*

NICHOLAS P. GODICI
*Acting Director of the United States Patent and Trademark Office*